US007552850B2

(12) United States Patent
Koeda et al.

(10) Patent No.: US 7,552,850 B2
(45) Date of Patent: Jun. 30, 2009

(54) CLOTHES HOLDING DEVICE

(75) Inventors: Fujio Koeda, Tokyo (JP); Kei Matsuzawa, Kawaguchi (JP)

(73) Assignees: Nihon University, Tokyo (JP); Seems Inc., Tokyo (JP)

( * ) Notice: Subject to any disclaimer, the term of this patent is extended or adjusted under 35 U.S.C. 154(b) by 124 days.

(21) Appl. No.: 10/575,168

(22) PCT Filed: Dec. 8, 2003

(86) PCT No.: PCT/JP03/15654

§ 371 (c)(1),
(2), (4) Date: Apr. 10, 2006

(87) PCT Pub. No.: WO2005/055779

PCT Pub. Date: Jun. 23, 2005

(65) Prior Publication Data

US 2007/0068981 A1 Mar. 29, 2007

(51) Int. Cl.
*A41D 27/22* (2006.01)

(52) U.S. Cl. ..... 223/87; 223/85; 223/92; 211/87.01; 211/104

(58) Field of Classification Search ..... 223/85, 223/87, 88, 89, 92, 94, 98, DIG. 3; 211/45, 211/48, 87.01, 104
See application file for complete search history.

(56) References Cited

U.S. PATENT DOCUMENTS 1,158,358 A * 10/1915 Wordingham ..... 223/87
1,179,596 A * 4/1916 Wordingham ..... 223/87
1,510,915 A * 10/1924 Bartholdi ..... 223/87
1,619,742 A * 3/1927 Mayhew ..... 223/87
1,760,352 A * 5/1930 Feigelman ..... 223/87
1,797,364 A * 3/1931 Porter ..... 223/87
2,617,565 A * 11/1952 Suydam ..... 223/87
3,096,009 A * 7/1963 Jang ..... 223/87

(Continued)

FOREIGN PATENT DOCUMENTS

CN 2402219 Y 10/2000

(Continued)

OTHER PUBLICATIONS

International Search Report of PCT/JP2003/015654 dated Feb. 20, 2004.

(Continued)

*Primary Examiner*—Gary L. Welch
*Assistant Examiner*—Nathan E Durham
(74) *Attorney, Agent, or Firm*—Westerman, Hattori, Daniels & Adrian, LLP.

(57) ABSTRACT

The present invention provides a clothes holding device which is easily assembled (formed) as a clothes holding device (for example, a hanger), which is compact, which has an interior function for use as an interior material. The device includes a plate member having flexibility, wherein the plate member is bent on the symmetrical axis, and clothes are held with a resulting bent portion. When clothes are not held, the clothes holding device of the present invention is assimilated with the surface of a wall, and appears to be a part of a room's interior. When holding clothes, a vertical-directional lower area of the plate member is bent along the horizontal axis, and the bent portion and the remaining portion hold clothes.

3 Claims, 10 Drawing Sheets

U.S. PATENT DOCUMENTS

| | | | | | |
|---|---|---|---|---|---|
| 3,246,812 | A * | 4/1966 | Walker et al. | ..... | 223/87 |
| 5,501,378 | A * | 3/1996 | Kolton et al. | ..... | 223/87 |
| 6,135,330 | A * | 10/2000 | Wang | ..... | 223/85 |
| 2004/0031825 | A1 * | 2/2004 | Roberts | ..... | 223/85 |

FOREIGN PATENT DOCUMENTS

| | | | |
|---|---|---|---|
| JP | 9131/1975 | | 1/1975 |
| JP | 3068900 | | 3/2000 |
| JP | 2001-286382 | A | 10/2001 |
| JP | 2002-142954 | A | 5/2002 |

OTHER PUBLICATIONS

Chinese Office Action dated May 23, 2008, issued in corresponding Chinese Application No. 200380110805.1.

* cited by examiner

CLOTHES HOLDING DEVICE

TECHNICAL FIELD

The present invention relates to a clothes holding device such as a hanger used for holding clothes, especially, jackets.

BACKGROUND ART

As a clothes holding device, a hanger is generally known, and conventionally various improved techniques of the hanger have been proposed.

As an example, an arm-opening/closing hanger which can be easily opened/closed by a single hand even when the other hand is not available is disclosed (for example, see Japanese Published Unexamined Patent Application No. 2001-286382).

Further, an adjustable clothes hanger having a movable arm which moves from a central position in its lengthwise direction is disclosed (for example, see Japanese Published Unexamined Patent Application No. 2002-142954).

However, hangers according to the above-described conventional techniques have a large number of constituent parts, accordingly, the production cost is high.

Further, as the thickness of the hangers according to the above-described conventional techniques is not negligible, when plural hangers of the same type are packed and conveyed, the parcel is bulky.

Further, the constituent parts of the hangers according to the above-described conventional techniques are formed with different materials, when the hangers are disposed and recycled, a process to classify such parts of different materials is necessary. For this purpose, work and cost are increased.

Further, the hangers according to the above-described conventional-techniques, having a complicated structure, do not have an aesthetic design in some cases, which may soil fashionable touches of clothes to be held and the beauty of shop interior as exhibition space of the clothes.

Especially, in a ladies' dress shop where fashion is the main concept of business, it may be difficult to use the hangers according to the above conventional techniques without hesitation.

DISCLOSURE OF THE INVENTION

The present invention has been made in consideration of the problems of the above described conventional techniques, and has its object to provide a clothes holding device which improves the beauty of the interior of space to hold clothes without spoiling fashionable of the clothes.

In the clothes holding device of the present invention a flexible member (10A) forming the surface of a wall plane (W) is cut into a line symmetrical shape with a horizontal axis (X) as a symmetrical axis, however, a vertical-directional upper area (14T) is not cut, while a vertical-directional lower area (14B) is bent along the horizontal axis (X), and the bent portion (13) and a remaining portion (vertical-directional upper area 14T) hold clothes (claim 3).

In this case, an engagement member (21T, 21B; 16T, 16B; 23T, 23B) is provided in the vertical-directional upper area (14T) and in the vertical-directional lower area (14B), wherein the engagement members (21T, 21B; 16T, 16B; 23T, 23B) are engaged with each other, thereby a status where the vertical-directional lower area is bent along the horizontal axis (X) is maintained (claim 4).

BEST MODE FOR CARRYING OUT THE INVENTION

Hereinbelow, preferred embodiments of the present invention will now be described in detail in accordance with the accompanying drawings.

First, an example of a first embodiment in FIGS. 1 and 2 will be described.

Figure 1:
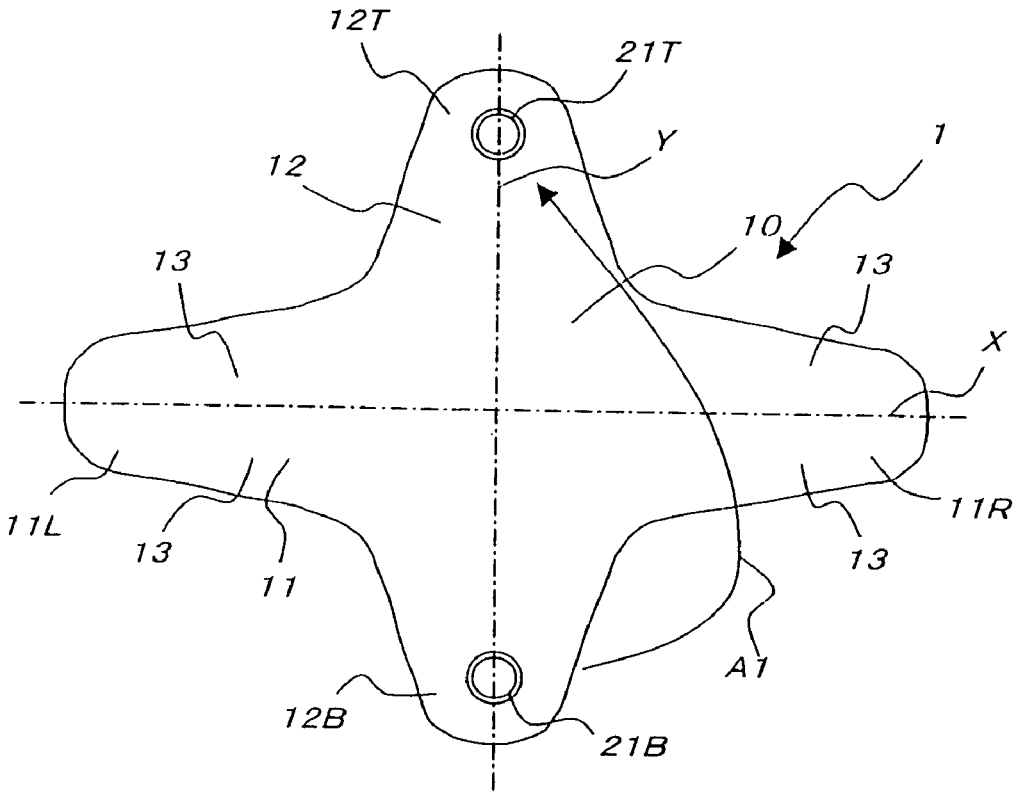
FIG. 1 is a developed status view of a hanger according to a first embodiment of the present invention.

FIG. 1 shows the status of a clothes hanger 1 according to the first embodiment when the hanger is not used. The clothes hanger 1 is line symmetrical with respect to a vertical axis Y and a horizontal axis X orthogonal to the Y-axis.

The clothes hanger 1 is formed with a plate main member 10 of e.g. resin having flexibility and a pair of hook buttons 21T and 21B of e.g. metal.

When the clothes hanger 1 is not used, the plate main member 10 has a horizontal shaft member 11 (bend 13) where rings are formed at both left and right ends 11L and 11R on the horizontal axis X and an outer edge becomes thick toward the center in the horizontal direction, and a vertical shaft member 12 where rings are formed at both upper and lower ends 12T and 12B on the vertical axis Y and an outer edge becomes thick toward the center in the vertical direction.

The horizontal shaft member 11 and the vertical shaft member 12 intersect and connected with each other in a so-called "cross" shape.

Further, a first hook button 21T is attached around an upper end (12T) of the vertical axis Y, and a second hook button 21B to be engaged with the first hook button 21T is attached around a lower end (12B) of the vertical axis Y.

Figure 2:
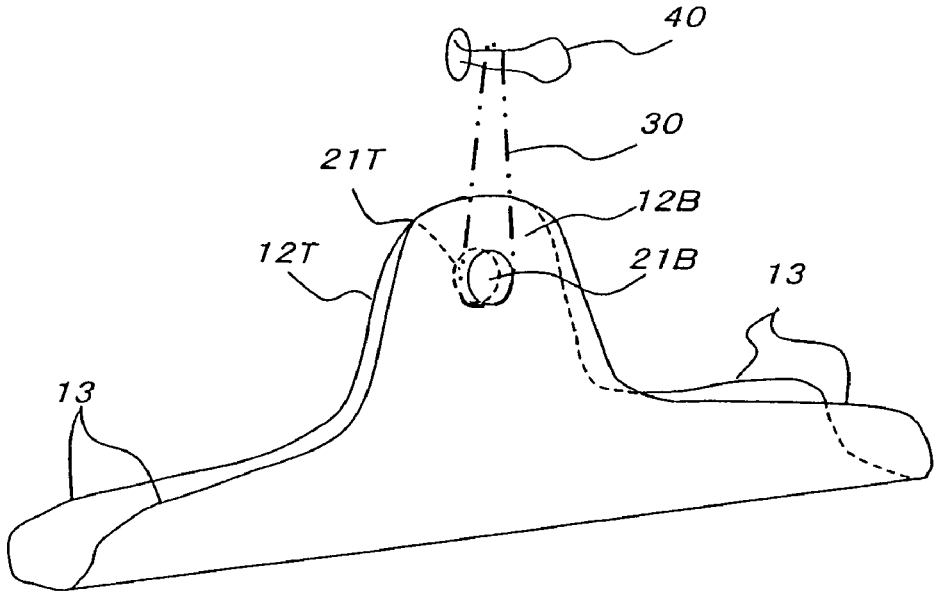
FIG. 2 is a perspective view stereoscopically showing the hanger according to the first embodiment of the present invention when the hanger is used.

When clothes hanger is used as a hanger, as indicated with an arrow A1 in FIG. 1, the hanger is round-folded along the horizontal axis X (see FIG. 1) (bent on the X-axis), and the first hook button 21T and the second hook button 21B are pressed to be engaged with each other (see FIG. 2).

As shown in FIG. 2, as the clothes hanger is used as a hanger by engaging the first hook button 21T and the second hook button 21B, when the clothes hanger 1 is hung on a wall or the like, upon folding and overlapping of the upper and lower ends 12T and 12B of the plate main member 10, a ring-shaped member, e.g., a string member 30, is previously put around the hook buttons 21T and 21B. Then, the string member 30 is hooked on a suspension bar member 40 mounted on the wall.

According to the above-described first embodiment, a plate member of e.g. plastic as the main member (plate main member) 10 is folded along the central horizontal axis X, and the pair of metal hook buttons 21T and 21B are engaged with each other. Accordingly, the hanger is very thin. In addition, when the hanger is not used, it is developed to the cut-out shape. Accordingly, a stack of the clothes hangers 1 is not bulky, and convenient for packaging and conveyance.

Since the plate main members 10 and 10A can be trim-cut with a trimming blade when plural formed-and-fabricated materials (flexible resin) S are overlaid, the productivity is very high.

As the processing of the plate main members 10 and 10A is merely cutting resin raw material S having flexibility, a free curve can be selected as a developed shape, and a high function of interior can be obtained. Accordingly, the clothes hanger can be applicable as a device (hanger) to hold clothes and an interior material.

As the pair of hook buttons 21T and 21B are used as the engagement members, the plate main member can be easily formed in a hanger shape by being folded at the center in the up-and-down direction and inserting the hook buttons 21T and 21B to each other.

Figure 3:
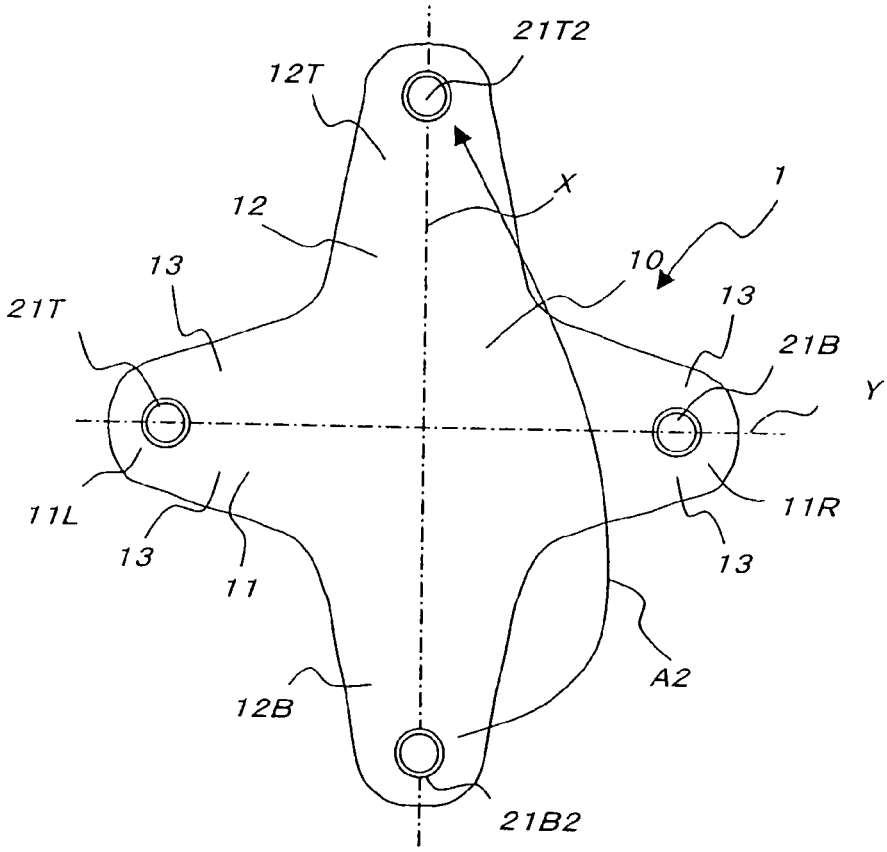
FIG. 3 is a developed status view of the hanger according to a second embodiment of the present invention.
Figure 4:
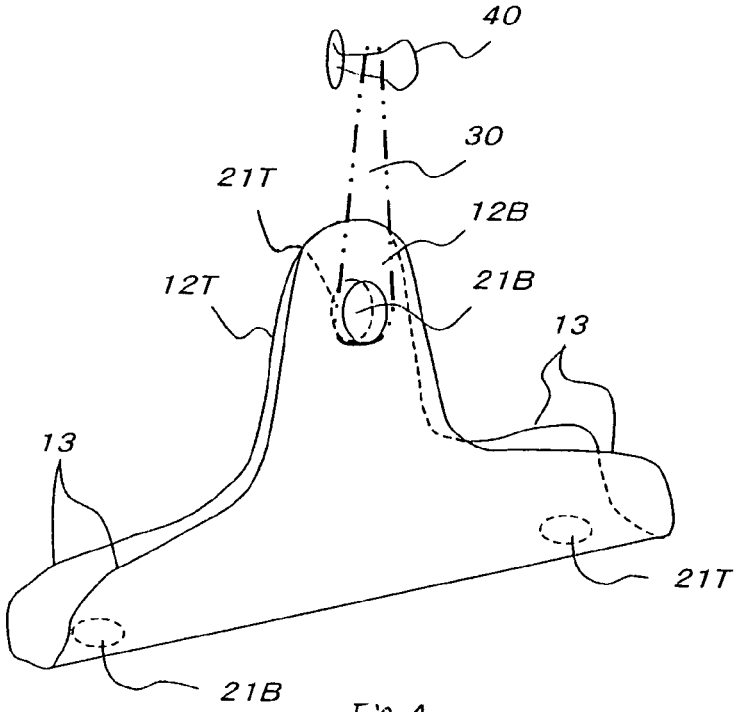
FIG. 4 is a perspective view stereoscopically showing the shape of the hanger according to the second embodiment of the present invention when the hanger is used.

FIGS. 3 and 4 show a second embodiment of the present invention.

In FIGS. 1 and 2, the pair of hook buttons 21T and 21B (the first hook button 21T and the first hook button 21B) are pressed and engaged with each other. On the other hand, in the second embodiment in FIGS. 3 and 4, two pairs of hook buttons 21T, 21B and 21T2, 21B2 are provided.

When the clothes hanger is used, when the hook buttons 21B and 21T are engaged, the plate main member is folded along the X-axis as in the case of FIGS. 1 and 2 (bent on the X-axis).

On the other hand, when the plate main member is folded (or bent) so as to engage the hook buttons 21B2 and 21T2 with each other, the plate main member is bent on the Y-axis as indicated with an arrow A2 in FIG. 3.

That is, in the second embodiment in FIGS. 3 and 4, when the clothes hanger is used as a hanger, there are two axes as the center of bending. This point is the difference from the first embodiment in FIGS. 1 and 2 where the plate main member is bent on only one axis (X-axis) when the clothes hanger is used as a hanger.

In FIG. 3, the X-axis is longer than the Y-axis. As it is apparent from a comparison between FIGS. 2 and 4, the dimension of a clothes holding portion, i.e., the dimension corresponding to a shoulder length of a hanger bent on the X-axis as shown in FIG. 2 is longer than that of a hanger bent on the Y-axis as shown in FIG. 4.

Accordingly, in the hanger according to the second embodiment in FIGS. 3 and 4, when a man's garment with broad shoulders is to be held, the plate main member is folded along the X-axis, while a woman's garment with narrower shoulders is to be held, the plate main member is folded along the Y-axis. Thus, two ways of use can be selected.

In other words, the hanger according to the embodiment in FIGS. 3 and 4 can be used for clothes with plural shoulder lengths.

Regarding the other constituent elements and effects, the second embodiment in FIGS. 3 and 4 is the same as the first embodiment in FIGS. 1 and 2.

Next, a third embodiment of the present invention will be described with reference to FIGS. 5 to 8. In FIGS. 5 to 8, the clothes hanger is denoted by reference numeral 1B.

In the third embodiment in FIGS. 5 to 8, the difference from the embodiments in FIGS. 1 to 4 is that a member to engage the upper end 12T and the lower end 12B of the vertical shaft member 12 when a plate main member. 10B in a developed state is fold-bent along the horizontal axis X into a hanger shape is provided, and a design hole C is provided around the both ends 11L and 11R of the horizontal shaft member 11.

The member to engage the upper and lower ends 12T and 12B of the vertical shaft member 12 is formed as follows. That is, a semi-circular score (slit) 16T is formed in a position around the upper end 12T and an upper position in the figure. On the other hand, a semi-circular score (slit) 16B is formed in a position around the lower end 12B and an upper position in FIG. 5.

A hole 18 to hang the hanger 1B on a suspension bar member (not shown) is formed in approximately central positions of the two semi-circular slits 16T and 16B.

Figure 5:
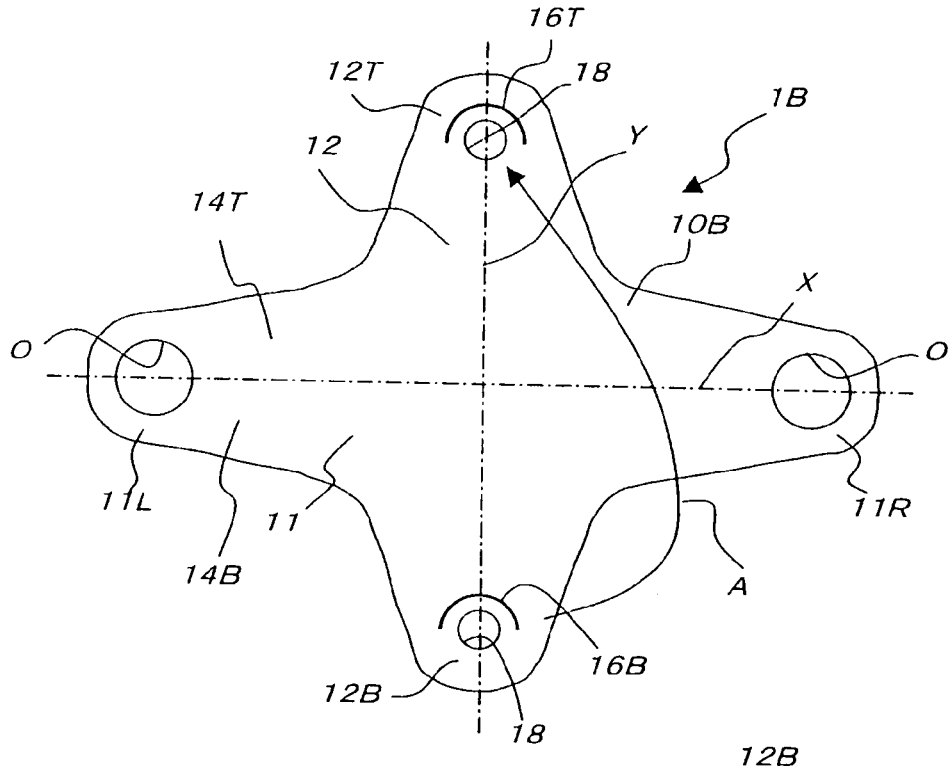
FIG. 5 is a developed status view of the hanger according to a third embodiment of the present invention.
Figure 7:
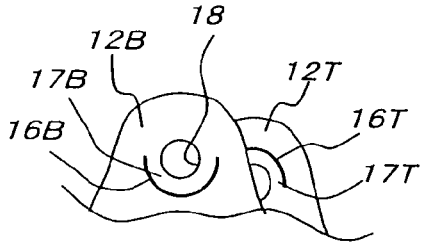
FIG. 7 is a partial stereograph showing engagement between engagement members in the third embodiment of the present invention.
Figure 8:
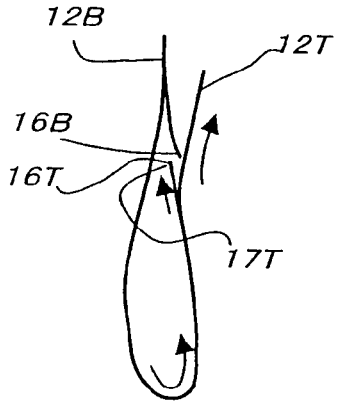
FIG. 8 is a side view showing engagement between the engagement members in the third embodiment of the present invention.

When the upper and lower ends 12T and 12B of the vertical shaft member 12 are engaged, a lower portion 14B below the horizontal axis X is fold-bent on the horizontal axis X toward nearside (in the direction of an upper portion 14T) as indicated with an arrow A (FIG. 5). Then as shown in FIG. 7 and 8, a tongue member 17T, surrounded by the slit 16T on the upper end 12T side and a straight line connecting the both ends of the slit 16T, is inserted into the slit 16B on the lower end 12B side convexed downward, thereby the upper end 12T and the lower end 12B are engaged with each other.

Figure 6:
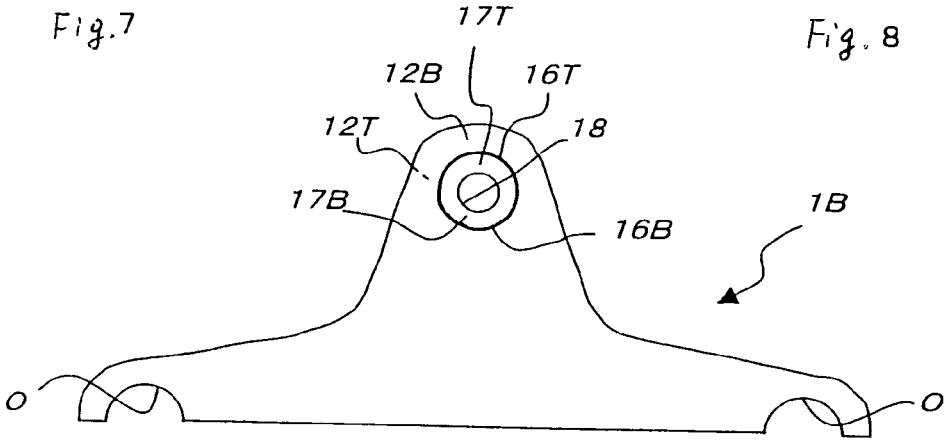
FIG. 6 illustrates the shape of the hanger according to the third embodiment of the present invention when the hanger is used.

FIG. 6 shows a status where the lower portion 14 is folded on the horizontal axis x (see FIG. 5), and, to use the plate main member as the hanger 1B, the upper end 12T and the lower end 12B are engaged by inserting and engaging tongue members 17T and 17B formed inside the slits 16T and 16B as the engagement members.

Regarding the other constituent elements and effects, the third embodiment in FIGS. 5 to 8 is the same as the above-described embodiments.

Next, a fourth embodiment of the present invention will be described with reference to FIGS. 9 to 11.

Figure 9:
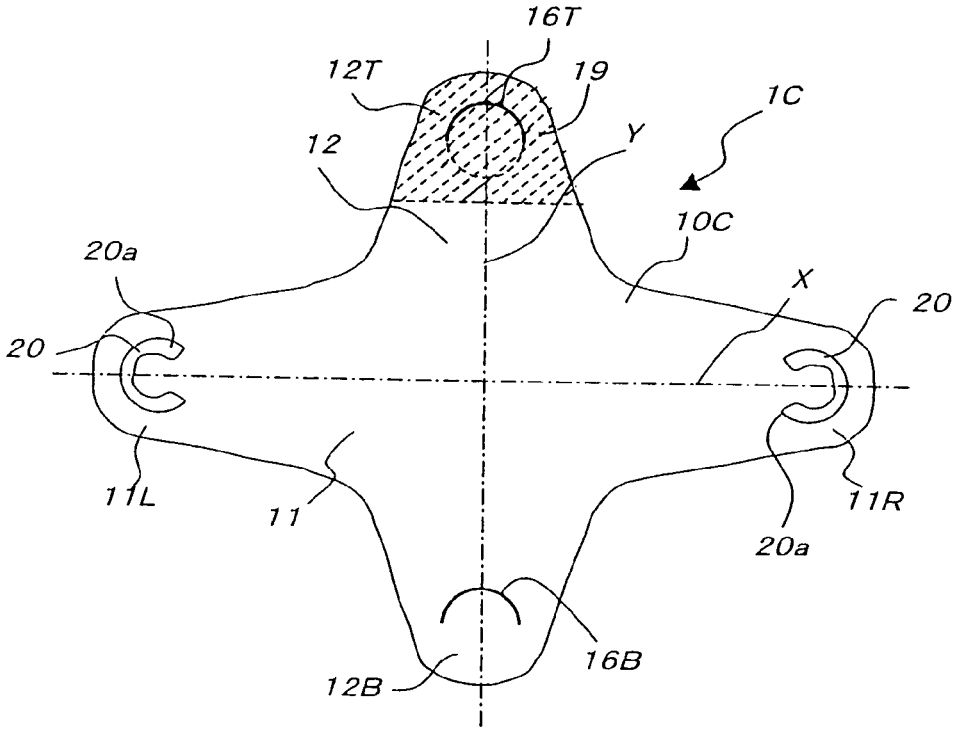
FIG. 9 is a developed status view of the hanger according to a fourth embodiment of the present invention.
Figure 10:
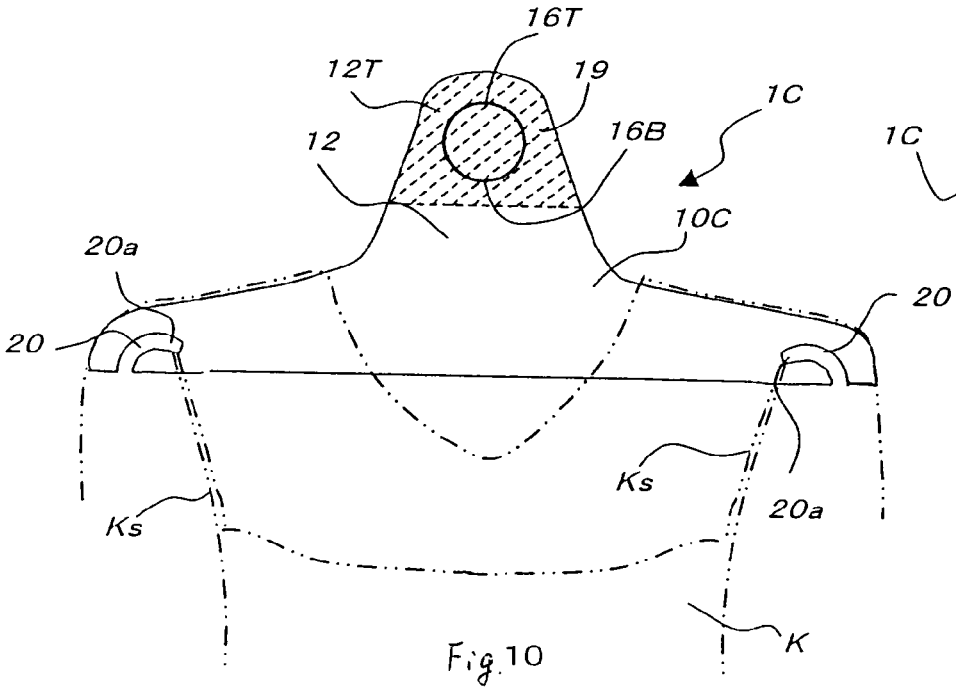
FIG. 10 is a front view showing the shape of the hanger according to the fourth embodiment of the present invention when the hanger is used.

In a clothes hanger 1C (as the plate main member, denoted by numeral 10C) according to the fourth embodiment of the present invention shown in FIGS. 9 and 10, the wall suspension member and the shape of design hole are different from those in the third embodiment in FIGS. 5 to 8. The difference from the third embodiment in FIGS. 5 to 8 will be described below.

In the clothes hanger 1C according to the fourth embodiment of the present invention shown in FIGS. 9 and 10, the suspension holes 18 formed in the approximately central positions of the two semicircular slits 16T and 16B in the third embodiment in FIGS. 5 to 8 are omitted, instead, as shown in FIG. 9, a so-called flocked "magic tape" 19 is attached on the rear side of the upper end 12T of the plate main member 10C in the fourth embodiment.

Note that the engagement slits 16T and 16B to engage the upper end 12T and the lower end 12B remain.

Further, a horseshoe hole 20 is formed, with a curved end directed outside of the horizontal shaft member 11, around the both left and right ends 11L and 11R of the horizontal shaft member 11.

Figure 11:
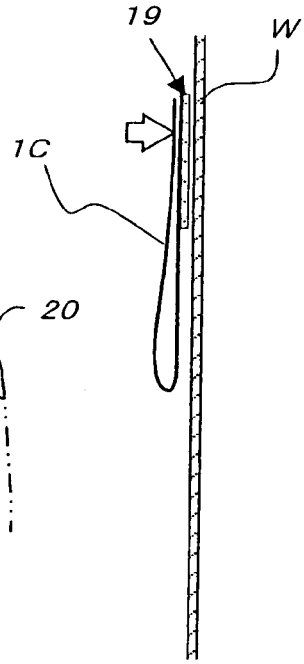
FIG. 11 is a side view showing the shape of the hanger according to the fourth embodiment of the present invention when the hanger is used.

As shown in FIG. 11, when the plate main member 10C is bent into a hanger shape and used, a strap of a garment (for example, straps Ks of a camisole K as a woman's wear) can be hooked in a rear end 20*a* of the horseshoe hole 20.

In the fourth embodiment in FIGS. 9 and 10, as the magic tape 19 is used as a wall suspension member, as shown in FIG. 11, the wall material W is a shaggy fabric. Accordingly, the hanger is appropriate to comparatively light-weighted clothes such as under clothes (see FIG. 11) as clothes to be hanged on the hanger 1C.

According to the fourth embodiment having the above-described structure, when the weight of clothes to be hanged is light, the hanger 1C can be suspended by merely pressing the magic tape 19 as a member to hang the hanger 1C on a wall or the like against, e.g., a shaggy fabric wall.

The other constituent elements and effects in the fourth embodiment are the same as those in the third embodiment.

Next, a fifth embodiment of the present invention will be described with reference to FIGS. 12 and 13.

Figure 12:
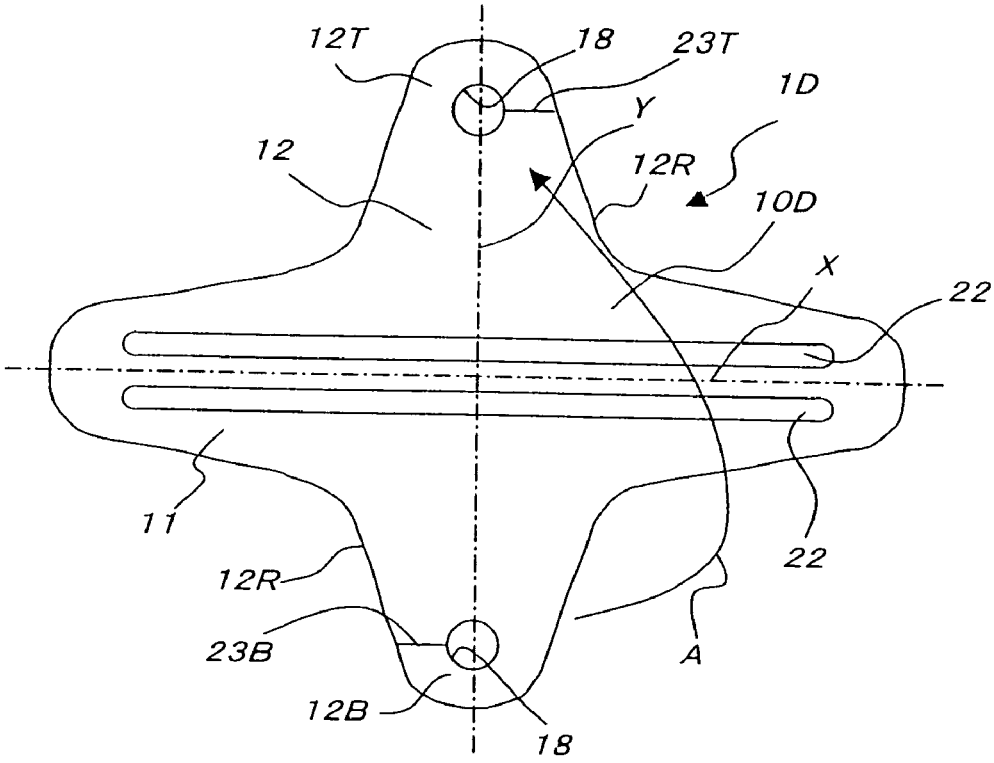
FIG. 12 is a developed status view of the hanger according to a fifth embodiment of the present invention.
Figure 13:
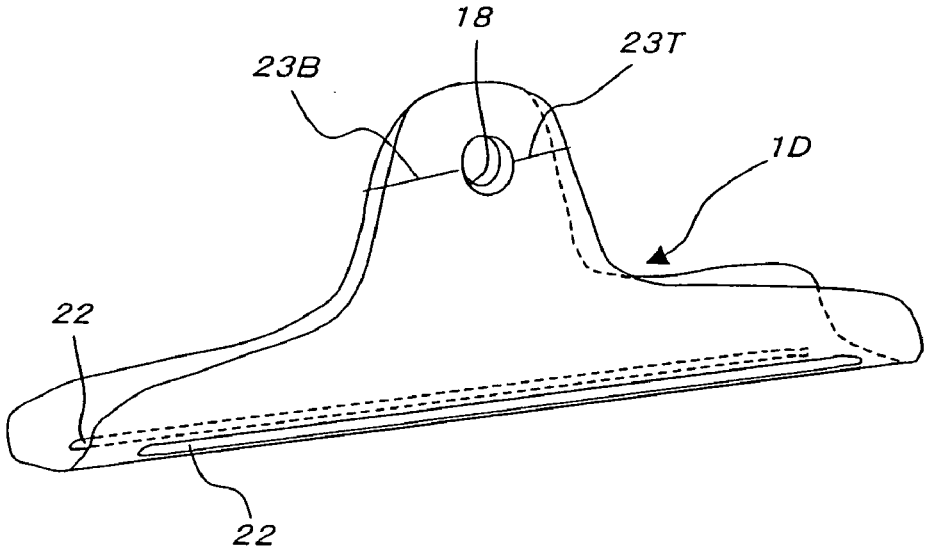
FIG. 13 is a stereograph showing the shape of the hanger according to the fifth embodiment of the present invention when the hanger is used.

A clothes hanger 1D (as the plate main member, denoted by numeral 10D) according to the fifth embodiment in FIGS. 12 and 13 has approximately the same outer shape (contour) as that in the respective embodiments in FIGS. 1 to 11.

In FIG. 12, in the plate main member 10D of the clothes hanger according to the fifth embodiment, upper and lower groove-type holes 22, 22 are formed above and below the horizontal axis X over approximately the entire length of the horizontal shaft member 11.

Suspension holes 18, 18 are formed in two positions on the vertical axis Y around the upper and lower ends 12T and 12B of the vertical shaft member 12. In the figure, in the suspension holes 18, 18, straight-line scores (slits) 23T (upper end side) and 23B (lower end side), connecting an outer edge 12R of the vertical shaft member 12 with the holes 18, are formed abeam the holes 18, 18 in mutually "angular" positions at the upper end and the lower end.

Upon engagement of the upper and lower ends 12T and 12B of the vertical shaft member 12, when the plate main member is folded as indicated with an arrow A in FIG. 12, the slit 23T on the upper end 12T side and the slit 23B on the lower end 12B side are mutually insert-engaged, thereby the upper end 12T and the lower end 12B are engaged with each other.

The two groove-type holes 22, 22 are applicable to suspension of a skirt, a muffler or the like (not shown) by passing the skirt or the like through these holes 22, 22.

Regarding the other constituent elements and effects, the fifth embodiment in FIGS. 12 and 13 is the same as the respective embodiments in FIGS. 1 to 11.

Next, a sixth embodiment of the present invention will be described with reference to FIGS. 14 and 15.

Figure 14:
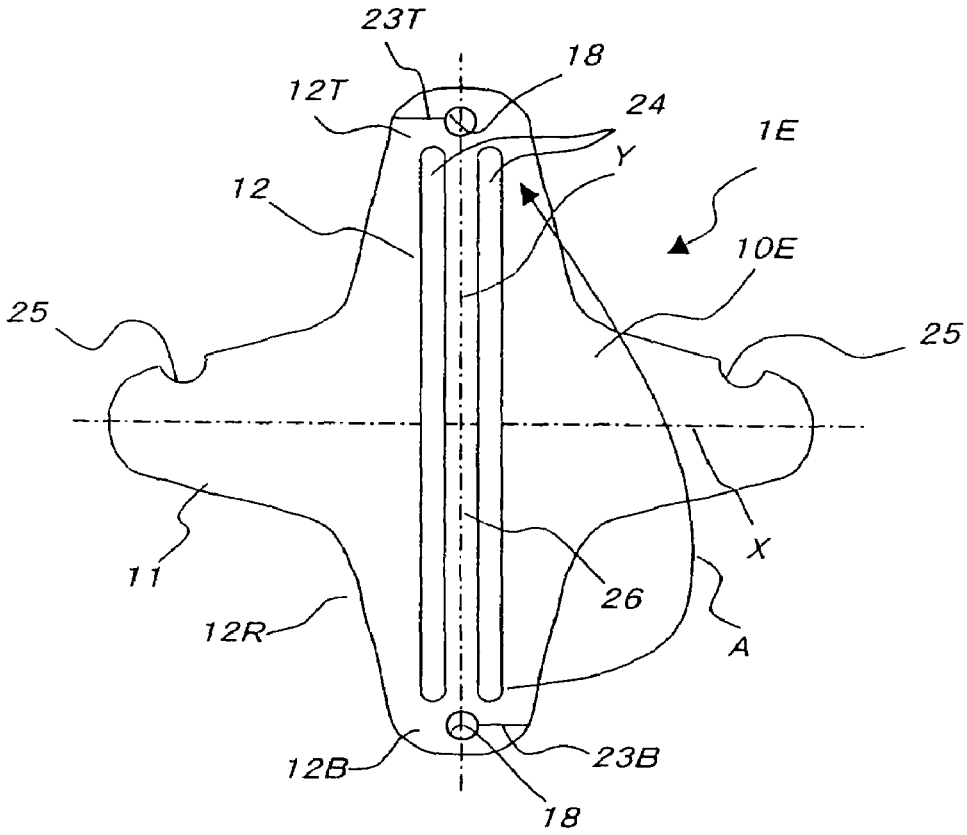
FIG. 14 is a developed view of the hanger according to a sixth embodiment of the present invention.
Figure 15:
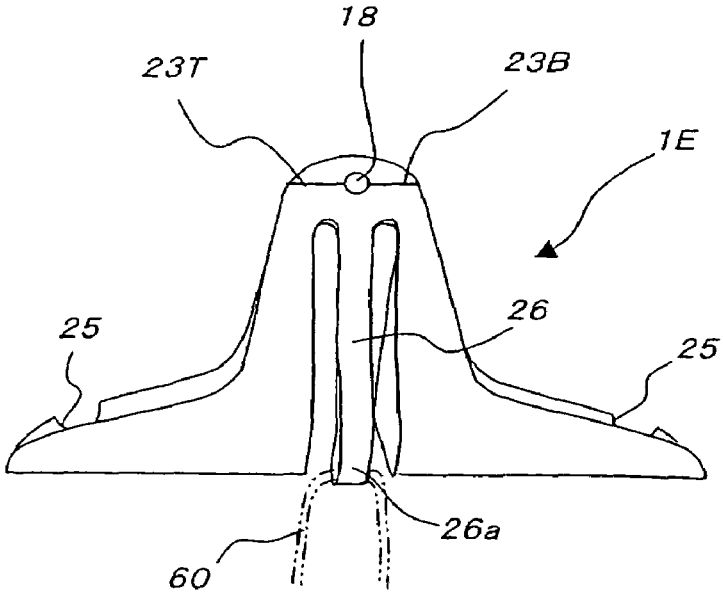
FIG. 15 is a stereograph showing the shape of the hanger according to the sixth embodiment of the present invention when the hanger is used.

As shown in FIG. 14, in a clothes hanger 1E (as the plate main member, denoted by numeral 10E) according to the sixth embodiment in FIGS. 14 and 15, left and right groove-type holes 24 are formed with the vertical axis Y therebetween, approximately the entire up-and-down directional length of the vertical shaft member 12.

Further, circular notches 25, 25 are formed in at least one of the upper and lower outer edges of the horizontal shaft member 11 of the plate main member 10E.

In FIG. 14, when the plate main member is folded as indicated with an arrow A and used as the hanger 1E, a belt 60 or the like can be passed through a central portion 26*a* of a bent bar member 26 between the two groove-type holes 24.

The other effects in the sixth embodiment are substantially the same as those in the above-described respective embodiments.

Next, a seventh embodiment of the present invention will be described with reference to FIGS. 16 to 18.

The respective embodiments in FIGS. 1 to 15 have an approximately cross-shaped plate main member as an independent clothes holding hanger. On the other hand, the seventh embodiment in FIGS. 16 to 18 is apparently different in that a part of a flexible member forming the surface of a wall plane (for example, a carpet) is available as a clothes holding hanger.

Figure 16:
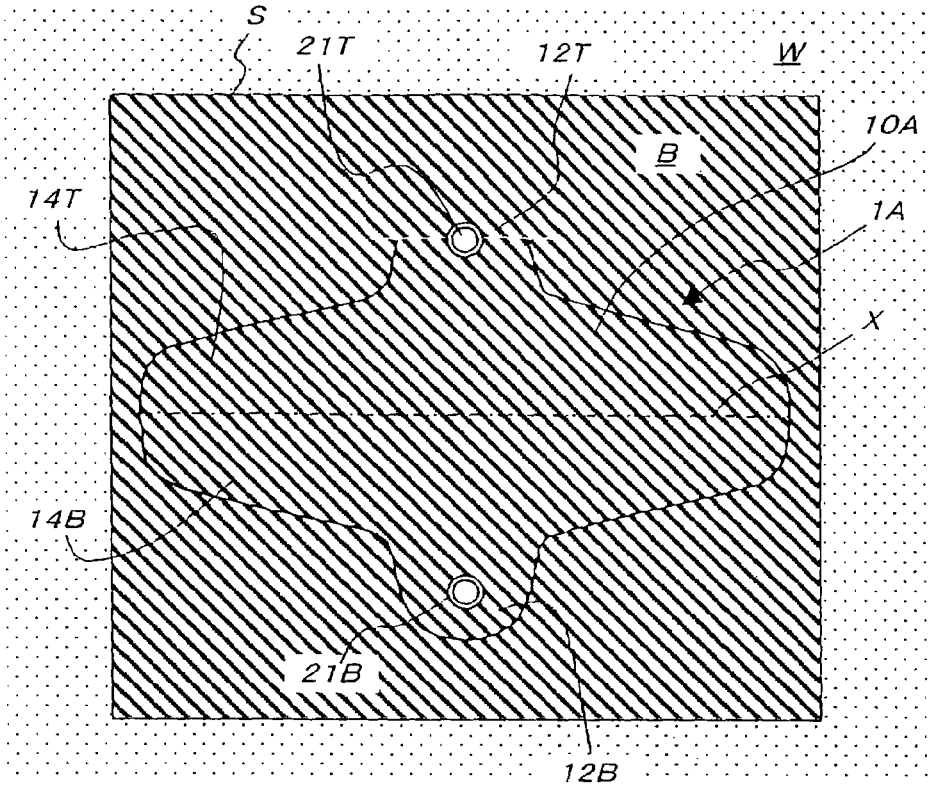
FIG. 16 is a front view in a seventh embodiment of the present invention when the hanger is not used as a hanger.
Figure 17:
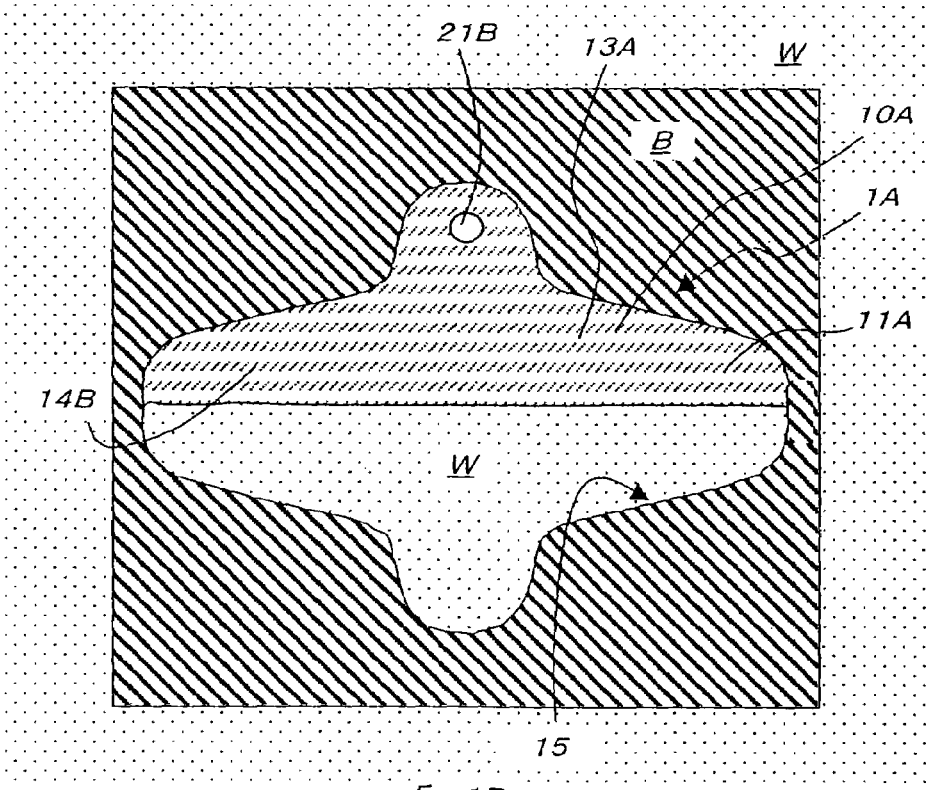
FIG. 17 is a status view according to the seventh embodiment of the present invention when the hanger is used as a hanger.
Figure 18:
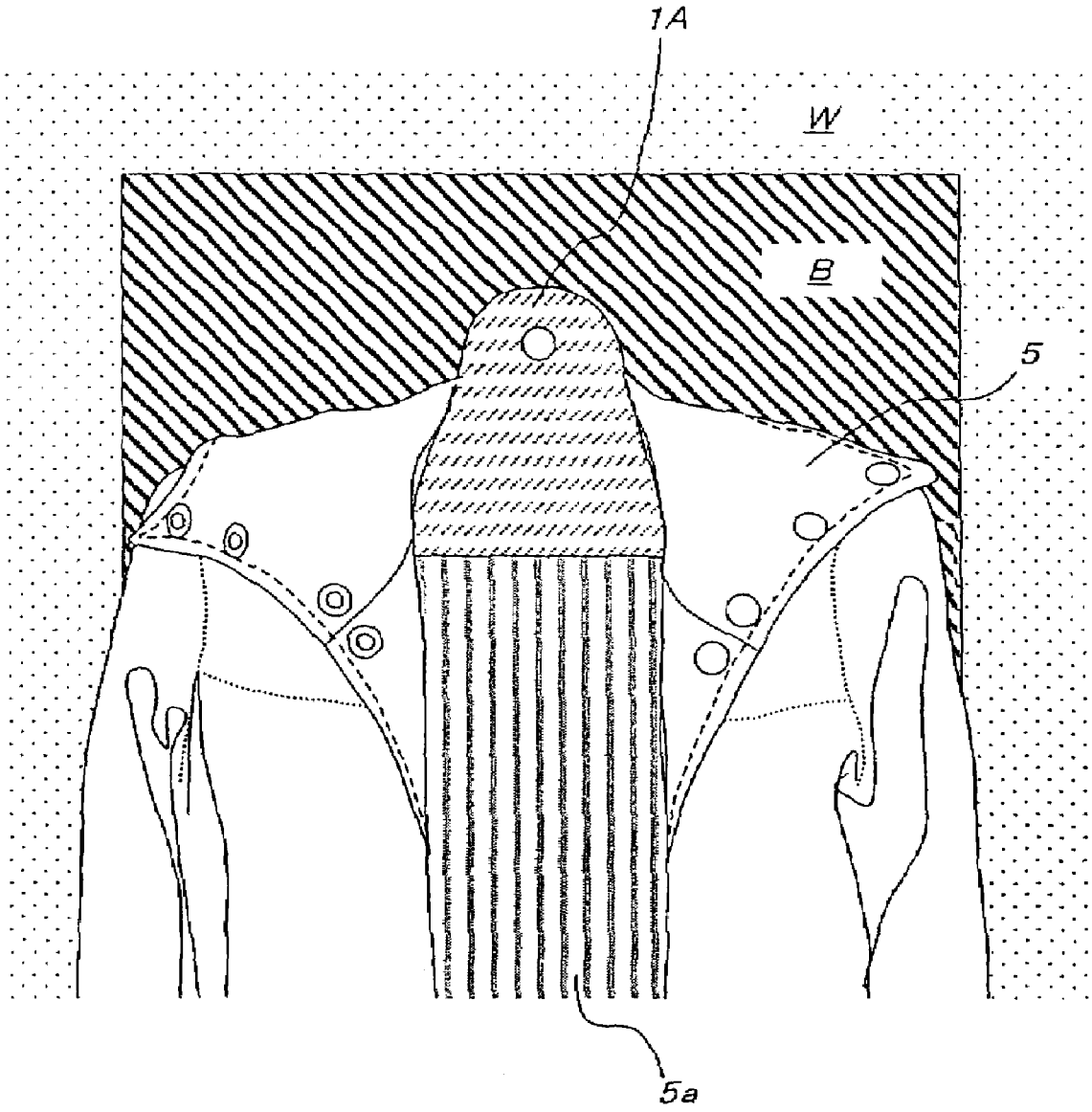
FIG. 18 is a status view in the seventh embodiment of the present invention when a coat is actually hung on the hanger.

As the seventh embodiment in FIGS. 16 to 18 uses a part of a flexible member forming the surface of a wall plane (a carpet or the like), it has a characteristic as an interior fabric in addition to a function as a device to hold clothes.

In FIGS. 16 to 18, a one interior wall plane (one inner wall plane) W and a flexible member S forming the clothes hanger according to the seventh embodiment are illustrated as if they were separate members and only one section of the wall plane W was covered with the flexible member S.

However, the illustration is made merely for the sake of convenience to clearly show the wall plane W and the flexible member S in the figures.

Actually, the flexible member S covers the entire interior-side surface of the wall plane W thus forming a surface of the wall plane W. In other words, the flexible member S shown as if it covered only one area of the wall plane W in FIGS. 16 to 18 is a carpet or the like which covers the whole area of the one interior wall plane W and forms the surface of the one interior wall plane W.

In the flexible member S, at least as a part forming the plate main member 10A of the clothes hanger 1A, although not clearly shown in FIGS. 16 to 18, a laminated material, where non woven fabrics in different designs are used on the surface side and the rear side and a flexible material such as resin plate is inserted therebetween, may be used.

In FIG. 16, in the flexible member S covering the whole area of the one interior wall plane W thus forming the surface of the wall plane W, a part of a shape corresponding to the plate main member 10A shown in FIG. 1 (in the embodiment in FIGS. 16 and 17, this part is also represented as a plate main member and denoted by numeral 10A) is almost cut out of the material S except its upper end. The plate main member 10A is connected with the flexible member S only via the upper end 12T.

In FIG. 16, the remaining part other than the plate main member 10A (or the other part) is denoted by alphabet B. In other words, FIG. 16 shows a status where the plate main member 10A is fitted in the remaining part B (the plate main member 10A is not pulled out from the remaining part B).

FIG. 17 shows a status where the plate main member is bent on the horizontal axis X by folding the lower portion 14B along the X-axis in FIG. 16 upward, and the hook buttons 21T and 21B are engaged with each other, thereby the plate main member is formed in a hanger shape as the clothes holding hanger 1A.

The wall W appears from a cut-out trace 15 of the lower portion 14 that is folded upward.

Note that in FIG. 4, numeral 11A denotes the horizontal shaft member; and 13A, a bent portion of the horizontal shaft member 11A.

FIG. 18 shows a status where a jacket 5 is held with the bent portion 13A of the horizontal shaft member 11A of the clothes hanger 1A in the status in FIG. 17. In FIG. 18, a liner 5*a* of the jacket 5 appears in a lower central portion of the clothes hanger 1A.

According to the seventh embodiment of the present invention having the above structure, as in the case of the first to sixth embodiments, the plate main member is bent on the horizontal axis X by folding upward the lower portion 14B of the carpet-like flexible member S below the X-axis forming the surface of the one wall plane W, thereby a part of the flexible member S functions as a clothes holding hanger.

Note that the flexible member S is cut in a line symmetrical shape with the horizontal axis X as a symmetry axis, however, the vertical-directional upper area 14T is not cut. Accordingly, when clothes are not held, the cut area maintains the state as the surface of the wall plane W.

That is, according to the seventh embodiment, in a status where clothes are not held, the clothes holding hanger 1A is assimilated in the flexible member S (for example, a carpet), and to the naked eye, it is grasped not as "a hanger not holding clothes" but "the flexible member S such as a carpet forming a part of the interior".

In this manner, the clothes holding hanger according to the seventh embodiment has a function as an interior material in addition to the original role to hold clothes.

Note that in some cases, even when the shape as the hanger 1A is maintained, the appearance of the wall W in the cut-out trace 15 as shown in FIG. 17 may produce an interior decorative effect.

Figure 19:
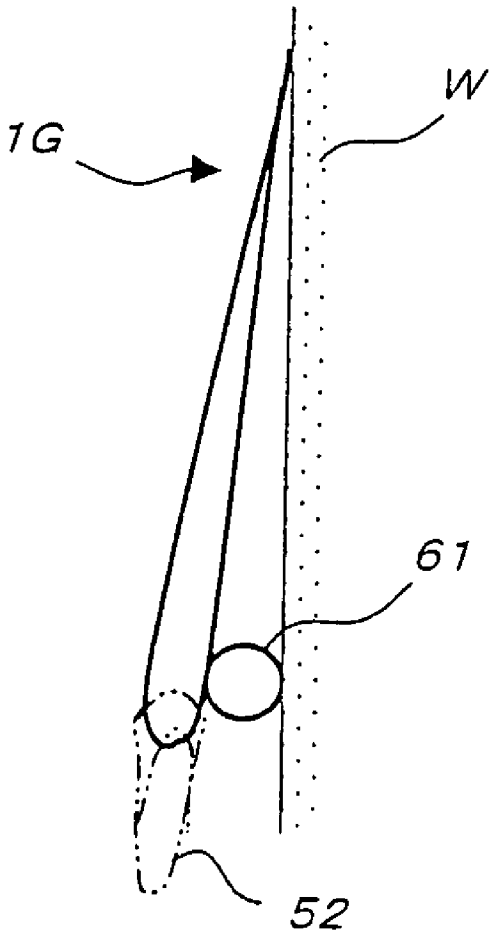
FIG. 19 is a side view showing a status in an eighth embodiment of the present invention when the hanger is used as a hanger.

Next, an eighth embodiment of the present invention will be described with reference to FIG. 19.

The eighth embodiment is approximately the same as the seventh embodiment, however, in the seventh embodiment, when the plate main member is used as a hanger (denoted by numeral 1G) as shown in FIG. 17, a spacer 61 is inserted in the rear of the hanger.

For example, when woman's clothes are displayed, the use of the spacer produces a three-dimensional display in a portion corresponding to the bust part.

The other constituent elements and effects in the eighth embodiment are the same as those in the seventh embodiment.

Next, a ninth embodiment of the present invention will be described with reference to FIGS. 20 to 22.

As in the case of the first to sixth embodiments, in the ninth embodiment, a line symmetrical plate main member is folded on a symmetry axis, thereby a clothes holding hanger is formed.

Figure 20:
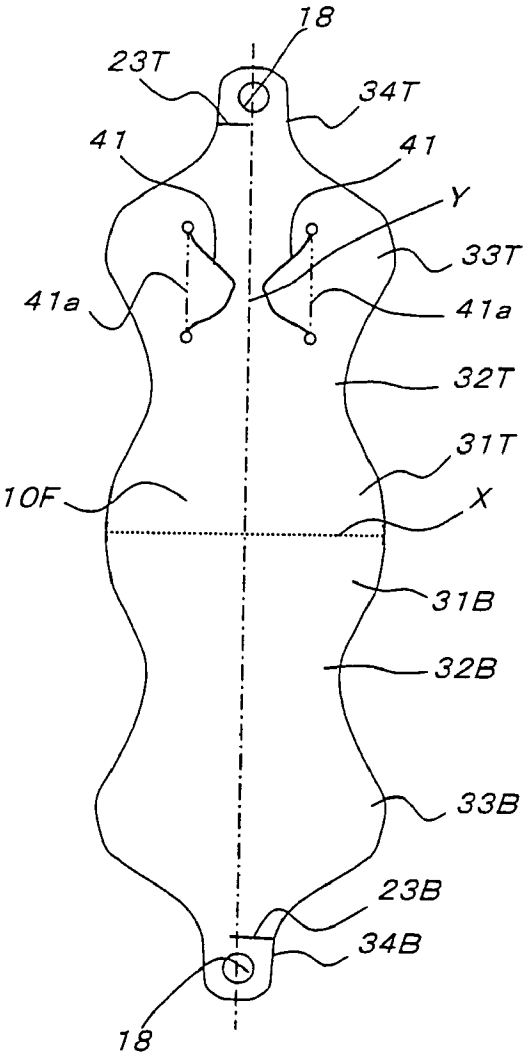
FIG. 20 is a front view showing a status in a ninth embodiment of the present invention when the hanger is not used as a hanger.

FIG. 20 shows a plate main member 10F when it is not used as a hanger.

Partial round members 31T and 31B, covering a woman's hip are formed in upper and lower central portions on the vertical axis Y with the horizontal axis X therebetween, constricted members 32T and 32B, continued from the partial round members 31T and 31B, corresponding to a woman's waste are formed, partial round members 33T and 33B, continued from the constricted members 32T and 32B, corresponding to a woman's bust are formed, and neck members 34T and 34B, continued from the partial round members 33T and 33B, are formed.

Further, the suspension holes 18, 18 and the slits 23T and 23B are formed in the neck members 34T and 34B.

Note that the alphabet T following the respective numerals (31 to 34) indicates the upper side from the horizontal axis X, while the alphabet B, the lower side.

Contours similar to a woman's bust viewed from a side position are formed as scores (slits) 41, 41 with their tips facing each other around the partial round member 33T corresponding to the upper side bust part from the horizontal axis X. FIG. 22 shows a status where the scores 41, 41 are folded along straight lines 41*a* connecting the upper and lower ends of the scores 41, 41 and the bust-shaped scores 41, 41 are risen vertically to the paper surface.

Figure 21:
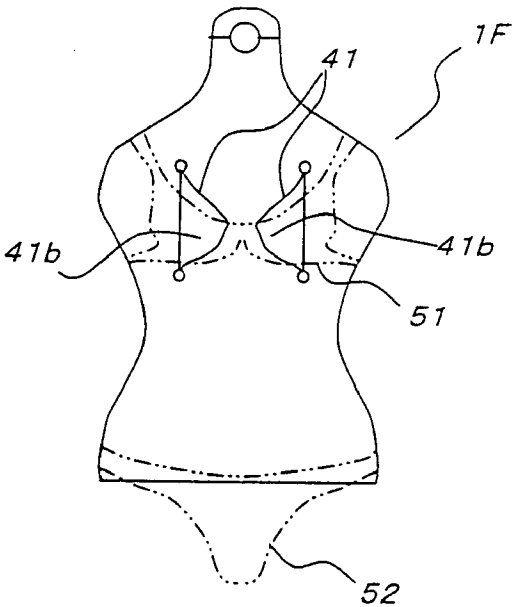
FIG. 21 is a status view in the ninth embodiment of the present invention when the hanger is used as a hanger.

Note that FIG. 21 shows the upper and lower parts of the plate main member which are folded along the horizontal axis X into a form for use as the hanger 1F.

Figure 22:
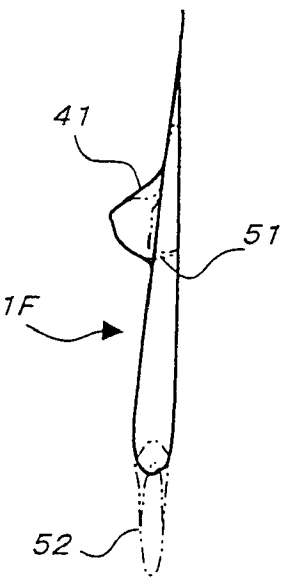
FIG. 22 is a side view showing the shape of the hanger in the ninth embodiment of the present invention when the hanger is used.

FIG. 22 shows a status where the FIG. 21 is viewed from a side position. Numeral 51 in FIGS. 21 and 22 indicates a bust part of e.g. a woman's swimming wear, and numeral 52, a waste part of the woman's swimming wear.

In this manner, parts of the hanger are risen with the scores 41, 41 thereby three-dimensional representation of the hanger is produced, thereby, in especially women's clothes, display corresponding to a woman's figure can be made.

As a result, when clothes are held with the hanger according to the eighth embodiment, since women as purchasers looking at the clothes (the woman's swimming wear in FIGS. 20 to 22) can imagine states where they wear them from the status held with the hanger, an effect to arouse buying inclination can be expected.

Further, as in the case of a so-called "lay figure", the hanger can also function as a shop interior material.

The other constituent elements and effects in the ninth embodiment are approximately the same as those in the first embodiment.

The illustrated embodiments are merely examples, but not descriptions to limit the technical scope of the present invention.

For example, the hook buttons 21T and 21B as the engagement members in the first and second embodiments in FIGS. 1 to 4 may be replaced with the scores (slits) 16T and 16B as the engagement members in the third embodiment in FIGS. 5 to 8.

Further, in the sixth embodiment in FIGS. 14 and 15, the notch 25 is formed only on the upper side, however, it may be formed in four positions in the upper and lower sides.

EFFECTS OF THE INVENTION

According to the clothes holding device of the present invention having the above structure (a clothes holding device in claims 1 and 2), the clothes holding device comprises a flexible plate member (10, 10A, 10B, 10C, 10D, 10E, 10F) having flexibility. Upon holding of clothes, the plate member (10, 10A, 10B, 10C, 10D, 10E, 10F) is bent on a symmetrical axis (X-axis or Y-axis), and a bent portion (13) holds the clothes.

That is, when it is not necessary to hold clothes (when not used), as the clothes holding device of the present invention is merely a plate member having a line symmetrical shape (developed in a cut-out shape), the plate is very thin. As a stack of large number of plates is not bulky, it is convenient for packaging and conveyance.

Further, upon manufacturing of the clothes holding device having the above structure, as the plate members can be cut (trim-cut) with a trimming blade when plural formed-and-fabricated materials (plate members S of flexible material) are overlaid, the productivity is very high. In other words, the production cost can be extremely low.

Upon manufacturing of the clothes holding device of the present invention (the clothes holding device in claims 1 and 2), as a manufacture process is merely cutting one plate member (formed-and-fabricated material S) having flexibility, a free curve can be selected as a developed shape. Accordingly, the freedom as a hanger shape is very high, and a shape in excellent design or a shape with a fashionable touch can be selected.

Accordingly, the clothes holding device of the present invention (the clothes holding device in claims 1 and 2) attains an effect that the hanger for holding clothes itself improves the beauty of interior.

Further, in the clothes holding device of the present invention where the line symmetrical shape is a cross shape (the clothes holding device in claim 2), when the two symmetrical axes are different in length, a function of a hanger for men's clothes having broad shoulders and a function of a hanger for women's clothes having narrow. shoulders can be performed with one hanger (the clothes holding device in claims 1 and 2).

According to the clothes holding device of the present invention having a flexible member (10A) forming the surface of a wall plane (W) (a clothes holding device in claims 3 and 4), the flexible member is cut in a line symmetrical shape with a horizontal axis (X) as a symmetry axis, however, as a vertical-directional upper area (14T) is not cut, when the device does not hold clothes, a status where the cut area forms the surface of the wall plane (W) is maintained.

That is, when clothes are not held, the clothes holding device (the clothes holding device in claims 3 and 4) is assimilated in the surface (for example, a carpet) of the wall plane (W), and grasped not as "a hanger not holding clothes" but as a part of interior.

Then, upon holding of clothes, a vertical-directional lower area (14B) is bent along the horizontal axis (X), and the bent portion (13) and the remaining portion (the vertical-directional upper area 14T) hold clothes.

In this manner, the above-described clothes holding device (the clothes holding device in claims 3 and 4) has a function as an interior material in addition to the original role to hold clothes.

In addition, according to a clothes holding device of the present invention (the clothes holding device in claims 1 to 4), as a large part of the constituent elements is a plate member having flexibility, almost no classification is necessary for recycling.

Accordingly, the device is appropriate to today's situation where the awareness of ecological problems is high.

The invention claimed is:

1. A combination of a clothes holding device and a wall, the clothes holding device comprising:

a flexible member as a wall covering which covers the entire surface of the wall and on which a slit is provided wherein a detachable portion of said flexible member is raised up from the entire wall via the slit, and the detachable portion of said flexible member is detachable from the wall in a line symmetrical shape with a horizontal axis as a symmetrical axis, and wherein a vertical-directional upper area is not detachable from the wall, so that a vertical-directional lower area is bent along the horizontal axis, and a bent portion and a remaining portion are capable of holding clothes when said detachable portion is detached, and when said detachable portion is not detached the bent portion and the remaining portion are assimilated in the flexible member formed on a surface of the wall and are thereby recognized as a portion of the surface of the wall to naked eyes.

2. The clothes holding device according to claim 1, further comprising an engagement member in the vertical-directional upper area and in the vertical-directional lower area, wherein the engagement members are engaged with each other, thereby a status where the vertical-directional lower area is bent along the horizontal axis is maintained.

3. The clothes holding device according to claim 2, wherein said engagement members are hook buttons.

* * * * *